US006572434B2

(12) United States Patent
Man

(10) Patent No.: US 6,572,434 B2
(45) Date of Patent: Jun. 3, 2003

(54) ROLLER COASTER TOY

(75) Inventor: Ma Cheuk Man, Tai Po (HK)

(73) Assignee: Echo Toys Ltd., Tai Po (HK)

( * ) Notice: Subject to any disclaimer, the term of this patent is extended or adjusted under 35 U.S.C. 154(b) by 130 days.

(21) Appl. No.: 09/909,231

(22) Filed: Jul. 19, 2001

(65) Prior Publication Data

US 2003/0017782 A1 Jan. 23, 2003

(51) Int. Cl.[7] ..... A63H 17/00

(52) U.S. Cl. ..... 446/431; 446/444; 446/446; 238/10 A; 238/10 E; 104/53; 104/DIG. 1

(58) Field of Search ..... 104/53, 63, DIG. 1; 238/10 R, 10 A, 10 E, 10 F; 472/43; 446/444, 445, 446, 447, 431

(56) References Cited

U.S. PATENT DOCUMENTS 921,416 A * 5/1909 Lauster ..... 472/43
4,568,305 A * 2/1986 De Anda et al. ..... 446/447
4,861,306 A * 8/1989 Bolli et al. ..... 446/445
5,272,984 A * 12/1993 Bolliger et al. ..... 104/63
5,297,484 A * 3/1994 Piserchia et al. ..... 446/446
6,220,171 B1 * 4/2001 Hettema et al. ..... 104/53
6,269,749 B1 * 8/2001 Hogg ..... 104/53
6,269,750 B1 * 8/2001 Cornwell et al. ..... 104/53

* cited by examiner

*Primary Examiner*—Derris H. Banks
*Assistant Examiner*—Urszula M Cegielnik
(74) *Attorney, Agent, or Firm*—Kirschstein et al.

(57) ABSTRACT

A roller coaster toy includes a set of cars mounted on a track. Each car has at least one pair of movable side wheel assemblies mounted for movement towards and away from opposite sides of a respective car to enable the cars to be easily placed on, or removed from, the track. A drive car has movable drive wheels for affirmatively engaging the track no matter the degree of curvature of the track.

15 Claims, 4 Drawing Sheets

ROLLER COASTER TOY

BACKGROUND OF THE INVENTION

1. Field of the Invention

The present invention generally relates to a roller coaster toy having interconnected cars driven along a track and, more particularly, to structures that insure that the cars remain on the track, especially during navigation along track sections of high curvature, and, still more particularly, to structures that enable the cars to be easily removed from, or mounted on, the track.

2. Description of the Related Art

A roller coaster toy, that simulates an amusement park ride consisting of a series of cars traveling along a narrow rail track on a framework shaped into extreme peaks and valleys and sharp bends, offers great entertainment value. However, the known roller coaster toys are not altogether satisfactory. It is desirable to make the known roller coaster toys so easy to mount on the track that even young children can do it. However, this usually results in the cars being more prone to falling of the track, especially when the cars need to navigate steep track sections, loops and sharp curves. Conversely, by making the cars less prone to falling off the track, young children, and even adults, typically find it more difficult to place the cars on the track to begin play, or to remove the cars from the track once the play activity has ended.

SUMMARY OF THE INVENTION

OBJECTS OF THE INVENTION

Accordingly, it is a general object of this invention to easily and quickly place cars on the roller coaster track, and reliably prevent the cars from falling off the track, even when navigating steep track sections, loops and sharp curves.

More particularly, it is an object of the present invention to provide a roller coaster toy of high entertainment reward.

FEATURES OF THE INVENTION

In keeping with the above objects and others which will become apparent hereafter, one feature of the present invention resides, briefly stated, in a roller coaster toy which comprises a track, a car, and a drive as the major components.

The track has a pair of parallel rails spaced apart by a predetermined distance. Each rail has an upper face, a lower face, an outer face, and a drive face. The track has a curved track section with a changing elevation.

The car has at least one pair of side wheel assemblies at opposite sides of the car. The side wheel assemblies are mounted on the car for movement between an outstretched position in which the side wheel assemblies are spaced apart by a distance greater than said predetermined distance, and a mounted position in which the side wheel assemblies are moved toward each other to engage the track. Each side wheel assembly has at least one upper guide wheel for engaging the upper face of a respective rail in the mounted position, and at least one lower guide wheel for engaging the lower face of a respective rail in the mounted position.

The drive is mounted on the car and includes at least one drive wheel for engaging the track in the mounted position. The drive is operative for driving the car along the track with the upper and lower guide wheels engaging the upper and lower faces of the rails.

The movement of the side wheel assemblies toward and away from each other not only enables the car to be easily and quickly placed on the track (the outstretched position), but also enables the car to be reliably held on the track (the mounted position). Preferably, each side wheel assembly has an outer guide wheel for engaging the outer face of a respective rail in the mounted position for greater securement on the track.

Another feature of the invention resides in mounting the drive wheel for vertical movement relative to the car. The drive wheel remains in constant biased engagement with the track during the driving of the car along the changing elevation of the curved track section. Preferably, the drive includes two drive wheels for respectively engaging the drive faces of the rails, a motor in force-transmitting relationship with the drive wheels, and a gear box operatively connected between the motor and the drive wheels. The gear box is mounted for pivoting movement on the car, and the drive wheel participates with this pivoting movement so that the drive wheel is affirmatively and constantly pressed against the drive face of a respective rail.

This feature enables the drive wheel to reliably engage the track even when navigating steep ascending or descending track sections, loops, or sharp curves. The car propels itself reliably along the track without falling therefrom.

Still another feature of this invention resides in providing a plurality of interconnected cars for the toy. One of the cars is a drive car and includes the aforementioned drive. Another of the cars, or preferably two additional cars, are power cars. Each power car includes a battery for supplying electrical power to the drive. Still other cars are toy cars and complete the simulation. Each car has the movable pair of side wheel assemblies described above. The drive car has the vertically movable gear box and drive wheel described above.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 8:
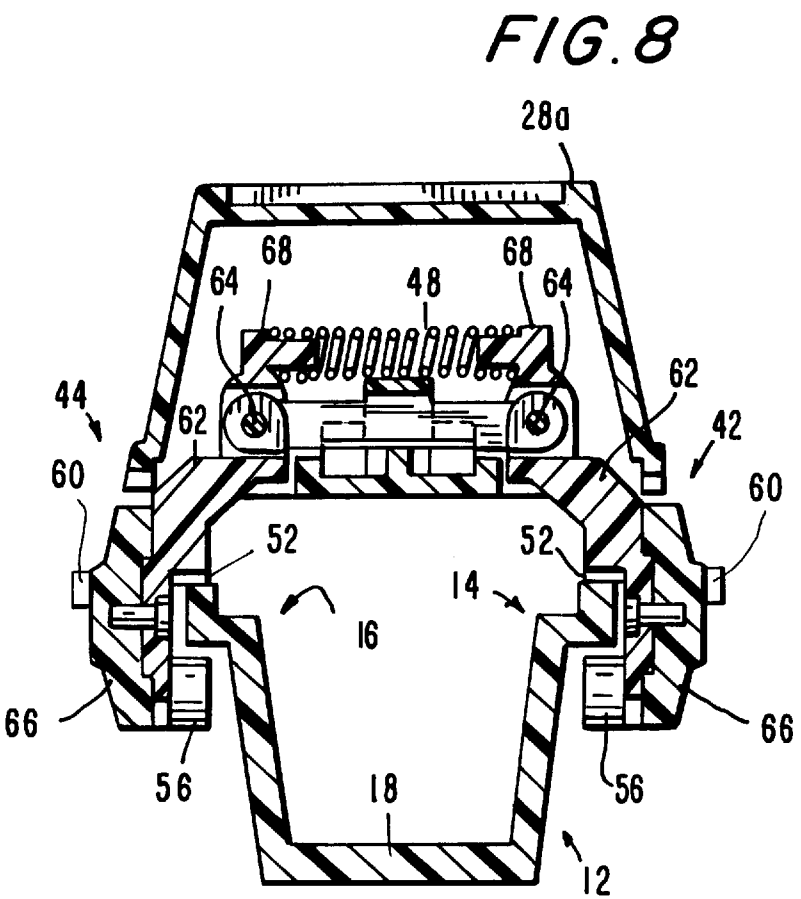
FIG. 8 is analogous to FIG. 7, but showing the side wheel assemblies in an outstretched position removed from the track.

Referring now to the drawings, reference numeral 10 generally identifies a roller coaster toy comprising at least one car, and preferably a plurality of cars, mounted on a track. As best seen in FIG. 8, the track 12 includes a pair of parallel rails 14, 16 spaced apart by a predetermined distance and interconnected by a crosstie 18. Rails 14, 16 respectively have upper faces 14*a*, 16*a*; lower faces 14*b*, 16*b*; and outer faces 14*c*, 16*c*.

Figure 6:
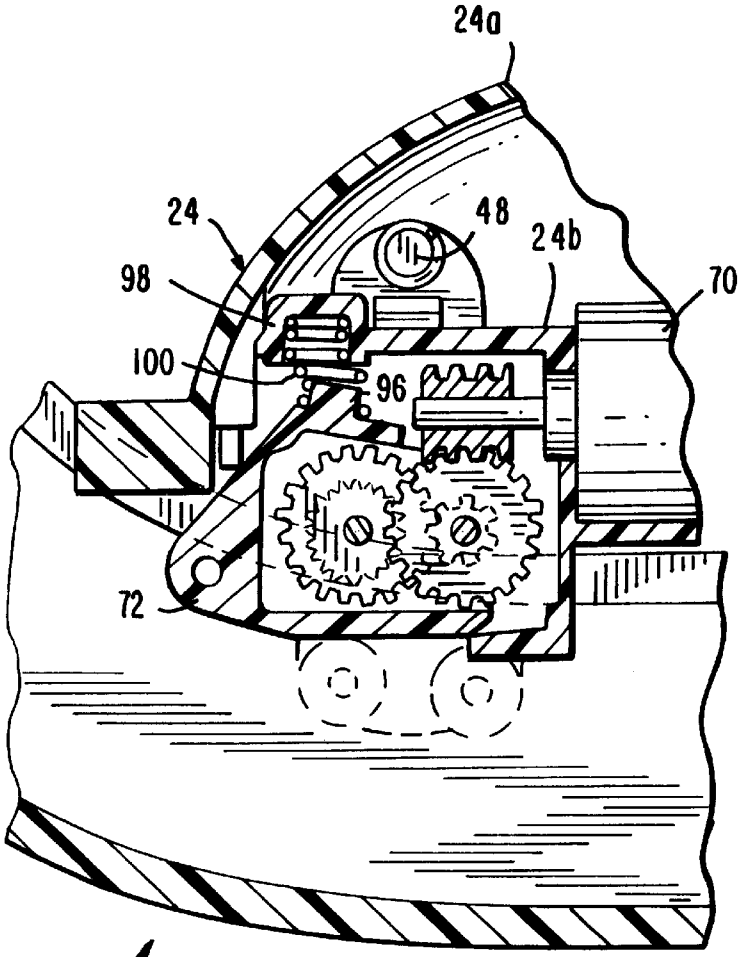
FIG. 6 is analogous to FIG. 5, but depicting travel along a curved track section.
Figure 5:
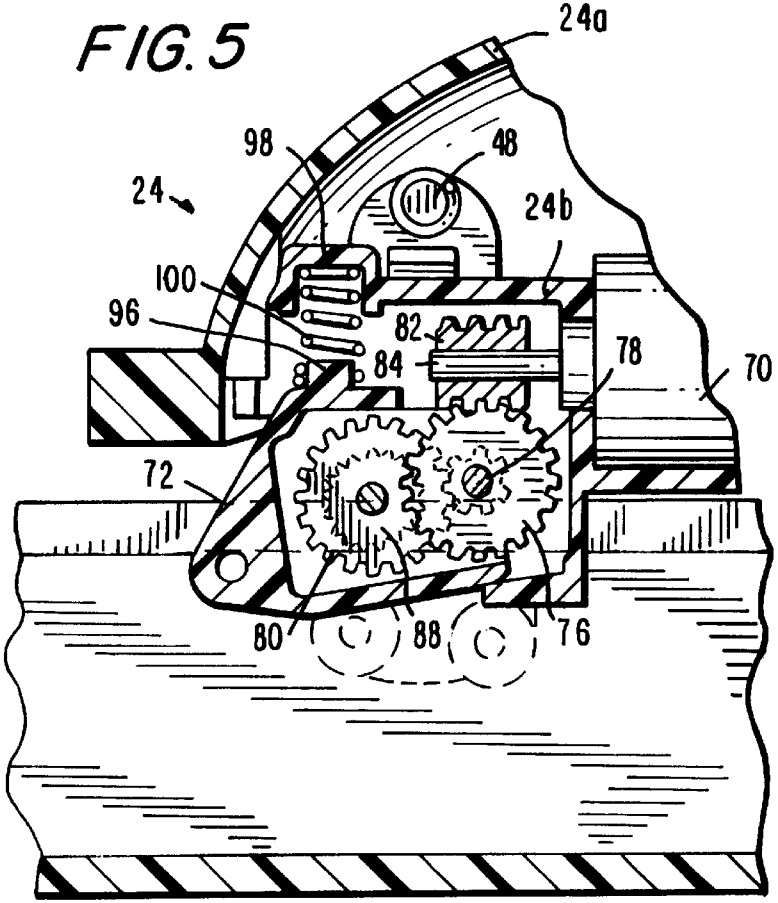
FIG. 5 is a sectional view of a gear box on a drive car shown in FIG. 3 during travel along a straight track section.

The track 12 has straight or linear track sections as seen, for example, in FIG. 5 and identified by reference numeral 20, as well as curved track sections as seen, for example, in FIG. 6 and identified by reference numeral 22. The curved track sections 22 may include an ascending or a descending track section, or a curved track section banked to the right or to the left, or a helical loop where the track section extends around a 360° arc. Each of these curved track sections extend along a path of changing elevation.

The track is constituted of a plurality of track sections, each section being connected end-to-end to complete an overall track assembly. Each track section is preferably molded of a synthetic plastic material. The preferred track cross section depicted in FIGS. 7–8 resembles a flattened U-shaped configuration.

The cars include a drive car 24, a power car 26 (and preferably two power cars), and toy cars 28 (and preferably more than two in number). Drive car 24 has an upper molded plastic shell 24*a* secured to a chassis 24*b* on which a drive for propelling the drive car, as described below, is mounted. Shell 24*a* has a streamlined front and simulated passenger seats. Power car 26 has an upper molded plastic shell 26*a*, also having simulated passenger seats, and mounted on a chassis 26*b* on which a power source, as described below, is mounted. Toy car 28 has an upper molded plastic shell 28*a*, also having simulated passenger seats, and mounted on a flat chassis 28*b*, and completes the simulation of an actual amusement park roller coaster ride.

Each car has at least one pair of side wheel assemblies at opposite sides of the car. Drive car 24 has one pair of side wheel assemblies 30, 32 at its front end, and another pair of side wheel assemblies 34, 36 at its rear end. Each power car 26 has one pair of side wheel assemblies 38, 40 at its rear end. Each toy car 28 has one pair of side wheel assemblies 42, 44 at its rear end. Successive cars are interconnected by strain-resistant, flexible tethers 46, preferably hollow tubing.

Figure 7:
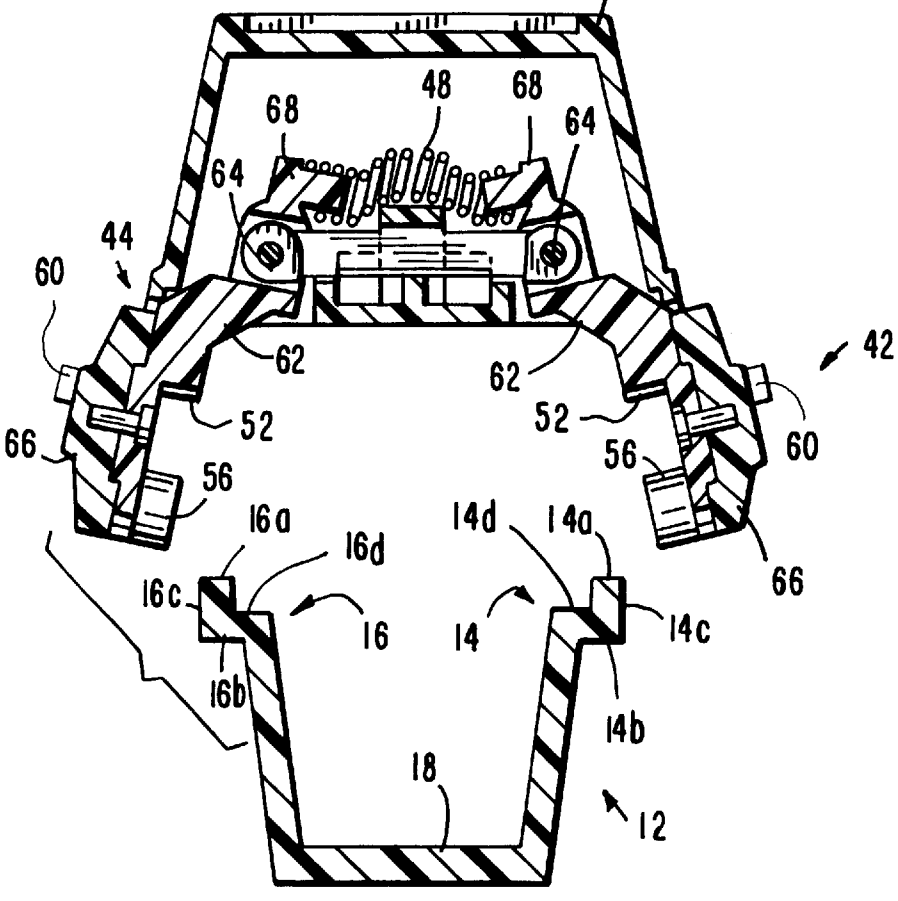
FIG. 7 is a sectional view taken on line 7—7 depicting a pair of side wheel assemblies in a mounted position on the track.

As shown in FIGS. 7–8 for the representative side wheel assemblies 42, 44, they are movable apart under tension provided by a biasing return spring 48 to an outstretched or outboard position depicted in FIG. 8, and are movable toward each other under a return force exerted by the spring 48 to a mounted position depicted in FIG. 7. In the outstretched position, the assemblies 42 44 are spaced apart by a distance greater than the predetermined distance between the rails 14, 16 so that the assemblies can easily be removed from, or placed and replaced on, the rails. In the mounted position, the assemblies are securely mounted on the track.

Figure 2:
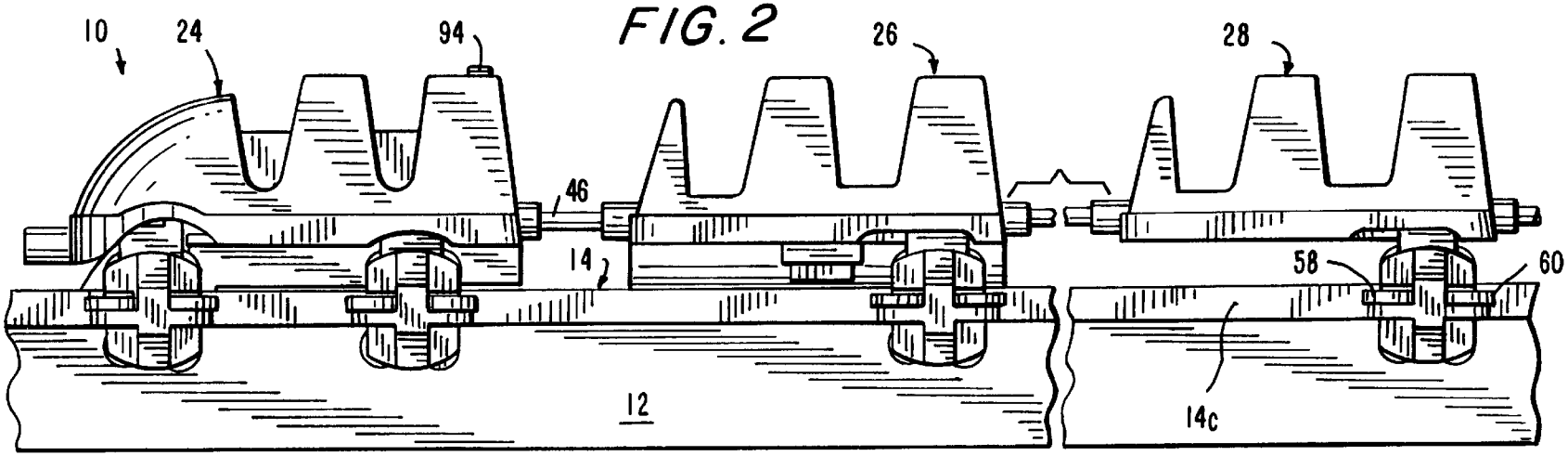
FIG. 2 is a side elevational view of FIG. 1.
Figure 3:
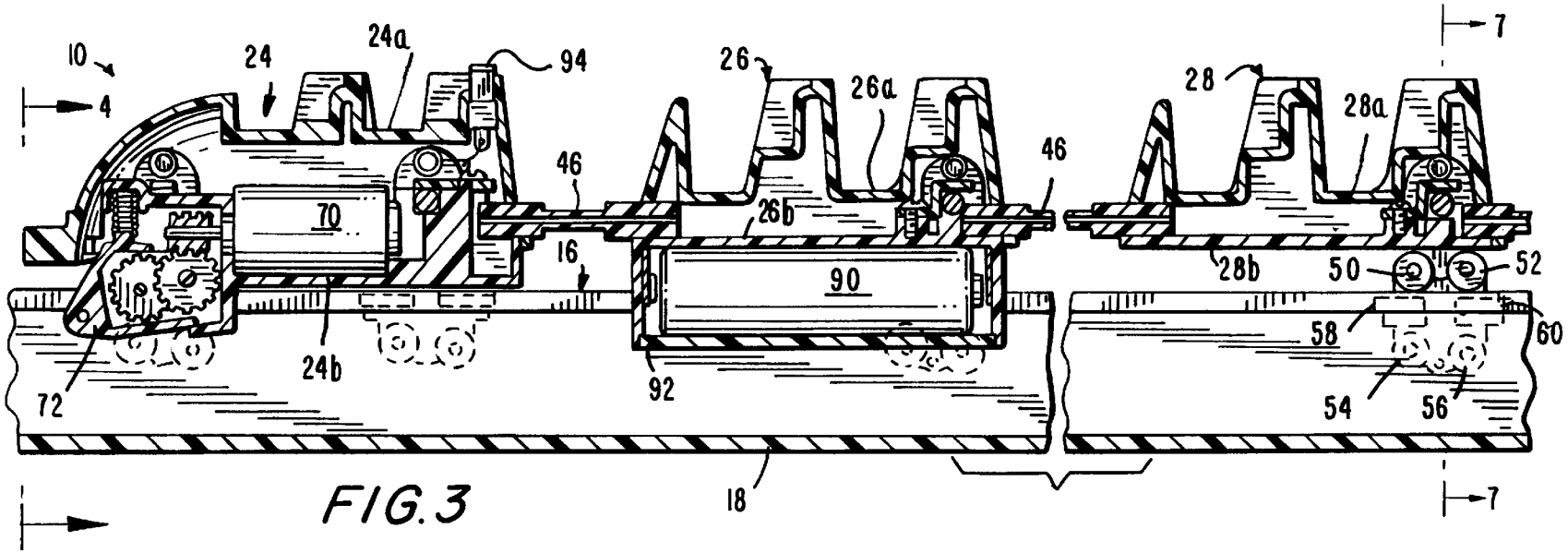
FIG. 3 is a sectional view taken on line 3—3 of FIG. 1.

Each representative side wheel assembly 44, 46 has at least one upper guide wheel, and preferably two upper guide wheels 50, 52 (see FIG. 3) for rollably engaging the upper faces 14*a*, 16*a* of rails 14, 16. Each assembly 4,4 46 also has at least one lower guide wheel, and preferably two lower guide wheels 54, 56 (see FIG. 3) for rollably engaging the lower faces 14*b*, 16*b* of rails 14, 16. Each assembly 44, 46 further has at least one outer guide wheel, and preferably two outer guide wheels 58, 60 (see FIG. 2) for rollably engaging the outer faces 14*c*, 16*c* of rails 14, 16.

Each representative side wheel assembly 44, 46 has a pair of arms 62 pivotably mounted at horizontal pivot pins 64. The arms 62 have lower hubs 66 on which the upper guide wheels 50, 52 and the lower guide wheels 54, 56 are mounted for turning movement about respective horizontal axes normal to the pivot pins 64, and on which the outer guide wheels 58, 60 are mounted for turning movement about respective vertical axes normal to the horizontal axes. The arms 62 also have upper stubs 68 which opposite open ends of the return spring 48 are fitted. The stubs 68 are moved closer together in the outstretched position and compress the spring 48. In the mounted position, the stubs 68 are pushed apart by the spring 48.

Each pair of side wheel assemblies 30, 32; 34, 36; and 38, 40 has the same construction and operation as that described for representative assemblies 42, 44 and, hence, will not be repeated for the sake of brevity and in order not to encumber the drawings. The assemblies effectively clamp their respective cars onto the track and resist fall-off, even when the cars are navigating steep and sharply banked track sections, and even when the cars are upside down. Nevertheless, despite this effective clamping action, the cars can easily be removed from the track after play by simply moving the side wheel assemblies apart.

Figure 4:
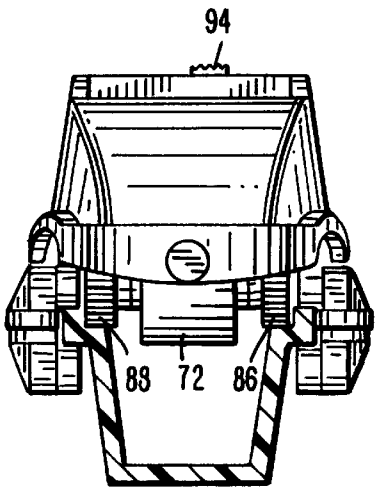
FIG. 4 is a front sectional view taken on line 4—4 of FIG. 3.

Propulsion of the cars is effected by a drive in the drive car 24, and includes an electrical DC motor 70 mounted on the chassis 24*b*. As best seen in FIGS. 5–6, a gear box 72 is pivotably mounted on the chassis 24*b* for pivoting movement about a horizontal pivot axis. The gear box 72 contains a transmission consisting of gears 76, 78, 80 in meshing engagement. Large gear 76 engages a worm gear 82 fixed on a motor output shaft 84. Small spur gear 78 turns with large gear 76 and, in turn, turns large gear 80. At least one drive gear or wheel, and preferably a pair of drive gears or wheels 86, 88 (see FIG. 4), is mounted for joint turning movement with the large gear 80. The drive wheels 86, 88 frictionally engage a pair of drive faces 14*d*, 16*d* (see FIG. 8) on the rails 14, 16. The outer peripheries of the drive wheels are roughened, and are preferably ribbed, to increase the friction between the drive wheels and the rails.

Figure 1:
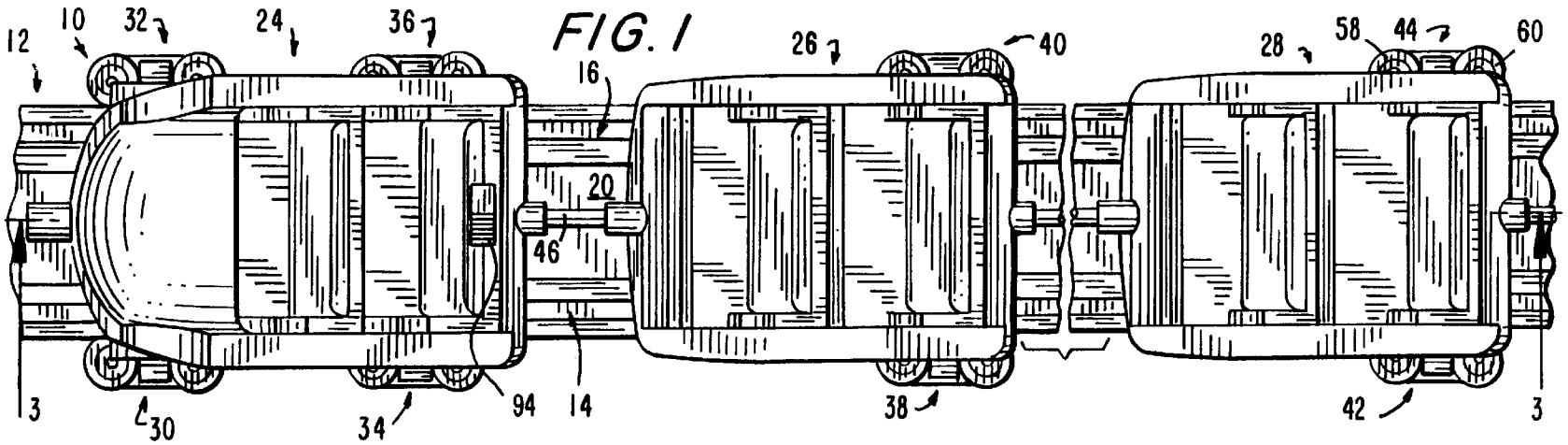
FIG. 1 is a broken-away, top plan view of a plurality of cars on a track in a roller coaster toy according to this invention.

In operation, the motor 70 turns its shaft 84 which, in succession, turns the worm gear 82, the large gear 76, the spur gear 78, the gear 80 and the two drive wheels 86, 88. Electrical power to the motor 70 is supplied by a battery 90 in a battery compartment 92 secured underneath the chassis 26*b* of the power car. Preferably, when two power cars 26 are used, two batteries, one in each power car, are employed. Electrical wires (not shown) are connected from the battery and are routed through the hollow tethers 46 to the drive car. An on/off switch 94 (see FIG. 1) on the drive car is connected to the wires and, in turn, to the motor for delivering the DC current when the switch is in the on state, and for interrupting the current when the switch is in the off state.

Turning to FIGS. 5–6, when the drive car 24 traversing the straight track section 20 enters and travels along the curved track section 22, the drive car is constrained to follow the curvature of the track by the guide wheels of the side wheel assemblies. This results in the drive wheels being lifted and spaced off the rails, especially when the drive car is upside down in a spiral looped track section.

Hence, in order to insure affirmative engagement of the drive wheels with the drive faces of the track at all times, the drive wheels 86, 88 are mounted with freedom of vertical movement. Specifically, the drive wheels which are mounted on the gear box 72 jointly move with the gear box about a horizontal axis. The gear box has an upper projection 96 which fits in one open end of a compression spring 100. A well 98 in the chassis 24*b* captures the opposite end of the spring 100.

In operation, the spring 100 constantly biases the drive wheels 86, 88 downwardly into driving engagement with the drive faces of the rails by urging the gear box 72 and the drive wheels outwardly away from the chassis 24*b*. As the elevation of the curved track section 22 changes, the drive wheels and the gear box are pushed by the rails in the opposite direction and compress the spring 100 as shown in FIG. 6. The movable gear box insures a strong frictional engagement between the drive wheels and the rails, no matter the degree of curvature of the track section being traversed.

It will be understood that each of the elements described above, or two or more together, also may find a useful application in other types of constructions differing from the types described above.

While the invention has been illustrated and described as embodied in a roller coaster toy, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A roller coaster toy, comprising:

a) a track having a pair of parallel rails spaced apart by a predetermined distance, each rail having an upper face and a lower face;

b) a car having at least one pair of side wheel assemblies at opposite sides of the car, said at least one pair of side wheel assemblies being mounted on the car for movement between an outstretched position in which the side wheel assemblies of said at least one pair are spaced apart by a distance greater than said predetermined distance, and a mounted position in which the side wheel assemblies of said at least one pair are moved toward each other to engage the track, each side wheel assembly of said at least one pair having at least one upper guide wheel for engaging the upper face of a respective rail in the mounted position, and at least one lower guide wheel for engaging the lower face of a respective rail in the mounted position; and c) a drive on the car, including at least one drive wheel engaging the track in the mounted position, and operative for driving the car along the track with the upper and lower guide wheels engaging the upper and lower faces of the rails.

2. The toy of claim 1, wherein the car has two pairs of the side wheel assemblies at opposite sides of the car.

3. The toy of claim 1, wherein each side wheel assembly of said at least one pair has two upper guide wheels and two lower guide wheels.

4. The toy of claim 1, wherein each rail has an outer face, and wherein each side wheel assembly of said at least one pair has an outer guide wheel for engaging the outer face of a respective rail in the mounted position.

5. The toy of claim 4, wherein each side wheel assembly of said at least one pair has two outer guide wheels.

6. The toy of claim 1, wherein each side wheel assembly of said at least one pair has an arm on which the guide wheels are mounted, and wherein each arm is pivotably mounted on the car for movement between the outstretched and mounted positions, and wherein each arm is constantly biased to the mounted position.

7. The toy of claim 1, wherein the drive includes two drive wheels for respectively engaging the rails, and a motor in force-transmitting relationship with the drive wheels.

8. The toy of claim 1, wherein the track has a curved track section with a changing elevation; and wherein said at least one drive wheel is mounted on the car for vertical movement and remains in constant biased engagement with the track during the driving of the car along the changing elevation of the curved track section.

9. A roller coaster toy, comprising:

a) a track having a pair of parallel rails, each rail having an upper face and a lower face, the track having a curved track section with a changing elevation;

b) a car having at least one pair of side wheel assemblies at opposite sides of the car, each side wheel assembly of said at least one pair having at least one upper guide wheel for engaging the upper face of a respective rail in a mounted position of the car on the track, and at least one lower guide wheel for engaging the lower face of a respective rail in the mounted position; and c) a drive on the car, including at least one drive wheel engaging the track in the mounted position, and operative for driving the car along the track with the upper and lower guide wheels respectively engaging the upper and lower faces of the rails, said at least one drive wheel being mounted for vertical movement and remaining in constant biased engagement with the track during the driving of the car along the changing elevation of the curved track section.

10. The toy of claim 9, wherein the drive includes two drive wheels for respectively engaging the rails, and a motor in force-transmitting relationship with the drive wheels.

11. The toy of claim 10, wherein the drive includes a gear box operatively connected between the motor and the drive wheels, and wherein the gear box is mounted for pivoting movement on the car.

12. The toy of claim 9, wherein the rails are spaced apart by a predetermined distance, and wherein said at least one pair of side wheel assemblies is mounted on the car for movement from an outstretched position in which the side wheel assemblies of said at least one pair are spaced apart by a distance greater than said predetermined distance, to the mounted position in which the side wheel assemblies of said at least one pair are moved toward each other to engage the track.

13. A roller coaster toy, comprising:

a) a track having a pair of parallel rails, each rail having an upper face, a lower face, and an outer face;

b) a plurality of interconnected cars, including a drive car, a power car, and a toy car, mounted on the track in a mounted position, each of the cars having at least one pair of side wheel assemblies at opposite sides of a respective car, each side wheel assembly of said at least one pair having at least one upper guide wheel for engaging the upper face of a respective rail in the mounted position, at least one lower guide wheel for engaging the lower face of the respective rail in the mounted position, and at least one outer guide wheel for engaging the outer face of the respective rail in the mounted position;

c) a drive on the drive car, including at least one drive wheel engaging the track in the mounted position, and operative for driving the drive car and, in turn, the power and the toy cars along the track with the upper, lower and outer guide wheels of each side wheel assembly of each car respectively engaging the upper, lower and outer faces of the rails, the drive including an electrical motor in force-transmitting engagement with said at least one drive wheel; and d) a power source on the power car, for supplying electrical power to the motor.

14. The toy of claim 13, wherein the drive includes an on/off power switch on the drive car for connecting and disconnecting, respectively, the electrical power to the motor.

15. The toy of claim 14; and further comprising a tubular tether between the drive car and the power car, and a plurality of electrical wires in the tether.

* * * * *